United States Patent [19]

Goettl

[11] Patent Number: 4,672,820

[45] Date of Patent: Jun. 16, 1987

[54] EVAPORATIVE COOLER PAD ASSEMBLY

[76] Inventor: Adam D. Goettl, 4960 E. Palomino Dr., Phoenix, Ariz. 85018

[21] Appl. No.: 840,191

[22] Filed: Mar. 17, 1986

[51] Int. Cl.[4] ..... F28D 5/00

[52] U.S. Cl. ..... 62/304; 261/106; 261/DIG. 41

[58] Field of Search ..... 62/304, DIG. 16; 261/DIG. 41, 106

[56] References Cited

U.S. PATENT DOCUMENTS 3,287,003 11/1966 Goetil ..... 261/DIG. 41

4,419,300 12/1983 Van Ness et al. ..... 261/DIG. 41

*Primary Examiner*—Henry A. Bennet

[57] ABSTRACT

A cooler pad assembly for use in evaporative coolers is provided with an improved wire rod grill structure for demountably holding a wettable pad medium in the air passage defined by the frame of the cooler pad assembly. The grill structure is demountably connected to the water distribution trough at the top end of the frame and depends therefrom in engagement with the pad medium to hold it in place. The grill structure, which may be formed of one or more independent grill segments, is mounted and configured so as to be in spaced non-engaging relationship with the frame other than its demountable attachment to the water distribution trough, and the grill is demountably held in place by an elongated bar which extends transversely of the frame structure and is in demountable engagement therewith.

22 Claims, 7 Drawing Figures

EVAPORATIVE COOLER PAD ASSEMBLY

BACKGROUND OF THE INVENTION

1. Field of the Invention

This invention relates generally to evaporative cooler structures and more particularly to an improved cooler pad assembly for use in such structures.

2. Description of the Prior Art

As is well known in the art, an evaporative cooler is an apparatus which is used primarily in warm arid climates for producing relatively low cost cooled air by utilization of the evaporation principle. Evaporative coolers include a cabinet-like housing having at least one cooler pad assembly demountably mounted in the side thereof. An air moving mechanism such as a fan or centrifugal blower is mounted in the housing and is operated to draw warm ambient air into the interior of the housing through the cooler pad assembly and direct the air to a point of use such as into a building. The evaporative cooler further includes a water containment and handling system for continuously circulating water through the cooler pad assembly to keep it wet and thereby cool the incoming air as it moves through the cooler pad into the housing.

The most commonly used type of cooler pad assembly includes a substantially rectangular frame structure which is formed of sheet metal and is configured to demountably contain a wettable pad medium that is held in place by means of an open wire rod grill.

The sheet metal frame structure is formed with an air inlet face in which a plurality of louvered openings are stamped or otherwise formed. An opposed pair of channel-shaped side members, a channel-shaped bottom member and a top water distribution trough coextend normally from the inner surface of the louvered face and cooperate therewith to define a chamber for containment of the wettable pad medium. The chamber provided by the frame structure has its outwardly facing planar surface defined by the louvered air inlet face and its opposite, or inwardly facing, planar surface is open and is surrounded by flanges formed integrally on the side and bottom frame members and on the water distribution trough of the frame structure.

The wettable pad medium may be formed of any suitable porous wettable medium with the most commonly used pad being formed of excelsior. An excelsior pad is formed into a rectangular pad which closely matches the interior configuration of the chamber defined by the frame structure by loosely packing the excelsior in a cheese cloth like wrapper. Such a pad is placed in the chamber of the frame structure through the open back and the wire rod grill is used to demountably hold the pad in the frame structure.

A first type of wire grill, which has been used for many years, is formed of relatively stiff small gage wire rods which are arranged in a crossed array in the manner of a checker board and are welded to form a grid-like network of vertical and horizontal rod, each having freely extending opposed ends. The open grid-like network, or grill, additionally has a plurality of normally extending prongs coextend from one surface thereof in spaced apart increments.

When the wettable pad is placed in the chamber of the frame structure, the wire rod grill is placed on the pad so that the prongs extend into the pad and hold it in place during use. The freely extending opposite ends of the horizontal and vertical rods of the grill are then placed under the flanges which define the back opening of the frame's chamber to hold the grill, and thus the pad, in place. Placing the ends of the rods under the flanges is difficult in that it usually involves simultaneous bending of the rods, deflecting of the flanges and pushing inwardly on the resilient pad medium to accomplish the installation. And, the same bending, deflection compressing of resilient pad medium must be accomplished when the time comes to replace the pad with a new one. Such replacement is recommended at least once during a season of evaporative cooler use, and preferably twice, due to the dirt and deposited mineral build-up in the pads. Replacement of the pad medium is often much more difficult than installation of a new one due to the above mentioned pad contamination which severely reduces its compressability and resiliency and due to rust and mineral deposition in the area where the wire rod grill is in engagement with the frame structure.

In any case, installation and replacement of the new wettable pad medium is difficult for some people to accomplish due to the difficulty encountered in installing and removing the wire grill. And, almost invariably, the rods of the grill and the flanges become bent and otherwise deformed.

In an effort to ease these installation replacement problems and reduce the above described structural damage, a relatively new type of wire rod grill has been devised. This prior art grill is formed in plural grill segments, two or three depending on pad size, and those segments are installed so that they extend across the pad assembly between the opposed side frame members of the frame structure. Each of the grill segments includes a spaced apart pair of longitudinally extending rods which are interconnected by U-shaped cross rods which, in addition to accomplishing the interconnecting function and also provide the needed pad engaging prongs. The aligned free ends of the longitudinal rods of each grill segment are bent into hook-shaped configurations on both ends thereof and the hook ends are inserted from the pad side through holes formed in the flanges of the side frame members to keep the grill segments from moving down in the frame. This second prior art grill structure, instead of easing the installation and removal problems, made it more difficult to install and virtually impossible to remove the grill structure. installation is difficult due to the need for engaging the hooked ends of the grill segments in the holes provided in both of the side frame members of the frame structure while simultaneously bending the grill segments, deflecting the flanges and compressing the pad medium. Grill segment removal is extremely difficult in that the pad medium becomes so hard that it cannot be compressed enough to allow disengagement of the hooks. This, along with corrosion and mineral deposits in the areas of the hooks makes it necessary in most, if not all, cases to cut the grill segments to accomplish the required removal.

Therefore, a need exists for a new and improved evaporative cooler pad assembly which overcomes some of the problems and shortcomings of the prior art.

SUMMARY OF THE INVENTION

In accordance with the present invention, a new and improved cooler pad assembly for use in evaporative coolers is disclosed. The cooler pad assembly includes the major components of a frame structure, a wettable pad medium, a grill means, and grill mounting retainer means.

The cooler pad frame structure, although having been modified in accordance with the present invention, includes the usual frame elements of a top water distribution trough, a bottom frame member, and an opposed pair of side frame members which cooperatively define an air passage or chamber having a planar air inlet face and a planar air outlet face. A plate having a plurality of louvered air openings formed therein is located at the air inlet face of the frame structure, and the air outlet face thereof is open. The top trough, bottom and side frame members each has a flange with those flanges surrounding the open air outlet face of the frame structure. The essentially conventional frame structure thus far described is modified in accordance with the present invention by having a plurality of apertures formed in spaced increments along the length of the flange of the top water distribution trough for reasons which will be hereinafter described.

The wettable pad medium of the cooler pad assembly of the present invention is conventional in that any wettable medium through which air may pass can be used. For example, a excelsior material loosely packed in a cheese cloth wrapper is a commonly used pad which may be used in the practice of the present invention by being located in the air passage defined by the frame structure.

The grill means of the cooler pad assembly is demountably connected to the frame structure so as to lie in the open air outlet face thereof and in engagement with the wettable pad medium for demountably holding it in the air passage of the frame structure. The grill means is formed of a plurality of relatively small gage wire rods which are interconnected in a manner which provides large openings through which air may freely pass. The grill means is directly and demountably connected to the flange of the top water distribution trough of the frame structure and is not in direct connection with any other part of the frame structure, and the connection is made in a manner which allows the grill means to be pivotably moved about a pivot axis defined by the connection. Therefore, the grill means can be swung into and out of engagement with the pad medium much like a door, and this eliminates the prior art problems of grill bending, pad compressing and frame deformation during grill installation and removal.

In the preferred embodiment, the grill means includes at least a pair of independent grill segments each having at least a pair of spaced apart elongated rods the aligned upper ends of which are formed into hook means to engage the apertures defined by the flange of the top water distribution trough. The elongated rods are interconnected at spaced increments along their lengths by cross rod means which are of U-shaped configuration to provide each of the cross rod means with a bight portion which extends between the elongated rods and a pair of normally extending prongs which penetrate the wettable pad medium to prevent it from sagging in the frame structure.

In addition to the grill means being demountably connected to the water distribution trough at the top of the frame structure, the above mentioned grill mounting retainer means is employed to complete the mounting of the grill means in the frame structure. The retainer means is an elongated bar that is placed in transverse overlaying bearing engagement with the grill means and has its opposite ends in demountable engagement with the flanges of the side frame members of the frame structure.

In the preferred embodiment, the grill mounting retainer means is of C-shaped cross section for receiving the bight portions of aligned ones of the cross rods of the grill means in the channel opening of the retainer means. This mounting relationship holds the retainer means in place by preventing it from sliding down in the frame structure. The opposite ends of the grill mounting retainer means may be placed in engagement with the flanges of the opposed side frame members by first being positioned in an angularly disposed attitude between the side frame members with the ends being under the flanges thereof. Then, by simply moving the retainer means from the angular attitude to its transverse fully installed position, the retainer means will be properly installed.

In a modification of the grill mounting retainer means, one of the ends thereof is provided with a longitudinally extensible latch. To install this modified form of the retainer means, the retainer bar is placed in the desired transverse mounting position with the extensible latch in the retracted position and with the other end of the retainer bar being located under the flange of one of the side frame members. Then, the longitudinally extensible latch is moved to its extended position wherein it will move under the flange of the opposite side frame member of the frame structure.

By configuring the evaporative cooler pad as described above, the installation of the grill means becomes simplified in comparison to the prior art and since no bending or other deformation of the grill and the flanges of the frame structure is required, damage to the cooler pad frame structure and the grill is eliminated.

Accordingly, it is an object of the present invention to provide a new and improved cooler pad assembly for use in evaporative coolers.

Another object of the present invention is to provide a new and improved cooler pad assembly which is configured to simplify assembly and disassembly and to eliminate damage resulting from such assembly and disassembly.

Another object of the present invention is to provide a new and improved evaporative cooler pad assembly which includes a frame structure defining an air passage, a wettable pad medium in the air passage of the frame structure, and a grill means and grill mounting retainer means for simplified and facile demountable mounting of the pad medium in the frame structure.

Another object of the present invention is to provide a new and improved evaporative cooler pad assembly of the above described character wherein the grill means is demountably connected to the top frame element of the cooler pads frame structure and is otherwise out of engagement with the frame structure, and the retainer mounting means is transversely disposed in overlaying engagement with the grill means and has its opposite ends in engagement with the opposed side frame members of the cooler pads frame structure.

The foregoing and other objects of the present invention as well as the invention itself, may be more fully understood from the following description when read in conjunction with the accompanying drawings.

DESCRIPTION OF THE PREFERRED EMBODIMENTS

Figure 1:
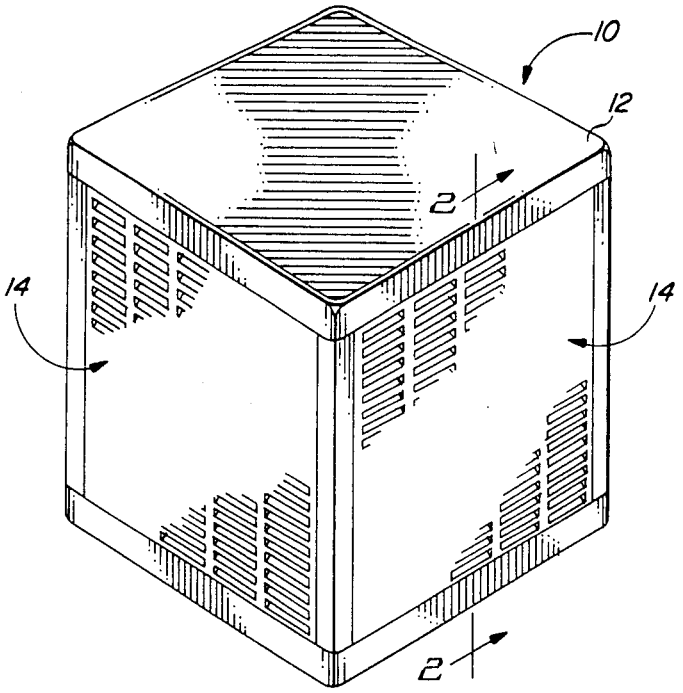
FIG. 1 is a perspective view of a typical evaporative cooler.

Referring more particularly to the drawings, FIG. 1 shows a typical evaporative cooler which is indicated generally by the reference numeral 10. The illustrated evaporative cooler 10 is shown as including a cabinet 12 having a cooler pad assembly 14 of the present invention removably mounted in each of the otherwise open sides thereof. Although some evaporative coolers will differ in configuration, the most commonly used coolers have three or four of such cooler pads.

Figure 2:
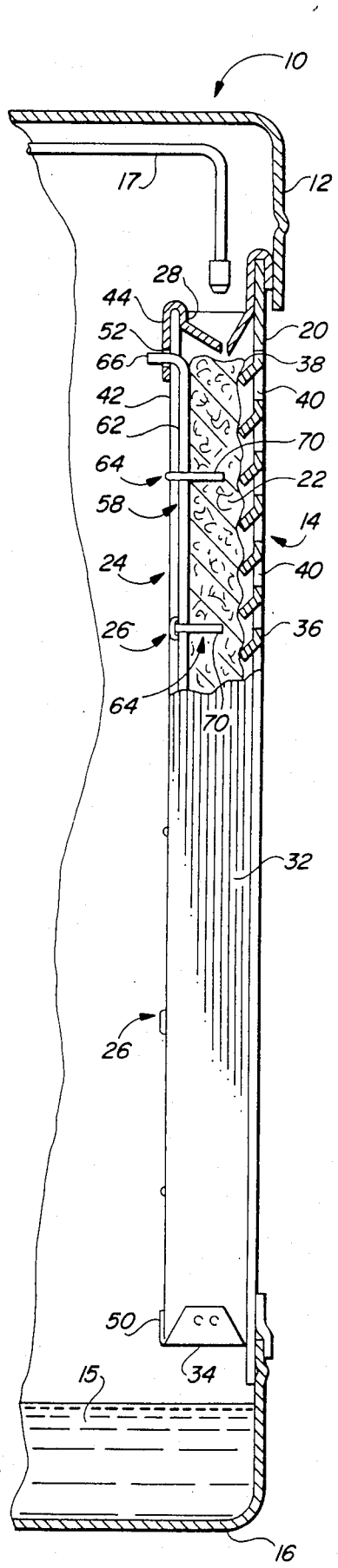
FIG. 2 is an enlarged fragmentary sectional view taken along the line 2—2 of FIG. 1 to show the installation and some of the various features of the cooler pad assembly of the present invention.

As will become apparent as this description progresses, evaporative cooler pad assemblies in general are employed to cool ambient air, as it is drawn through the pads into the evaporative cooler cabinet, by the well known process of evaporation. As seen in FIG. 2, the evaporative cooler 10 includes a water supply 15 which is contained in a sump 16. The water is supplied to a distribution pluming system 17 by means of a suitable pump (not shown), and the plumbing system distributes the water through the top of each of the cooler pad assemblies 14. The pad assemblies are therefore kept in a wetted condition by virtue of the received water trickling down through the pad under the influence of gravity. Relatively warm ambient air is drawn through the cooler pad assemblies 14 by suitable air moving mechanism (not shown) provided in the cabinet 12 of the cooler 10. As the air moves through the wet cooler pads 14, evaporation takes places as is well known in the art.

The cooler pad assembly 14 of the present invention includes the major components of a frame structure 20, a wettable pad medium 22, a grill means 24, and a grill means mounting retainer means 26, as will hereinafter be described in detail.

The frame structure 20 is provided with a top frame member 28 in the illustrated form of a water distribution trough, an opposed pair of side frame members 30 and 32, a bottom frame member 34 and a louvered plate 36. These frame members 28, 30, 32, 34 and 36 are normally formed of sheet metal and are configured so that the distribution trough 28, side and bottom frame members 30, 32 and 34 cooperatively define an air passage 38 through the frame structure 20. The plate 36 having a plurality of louvered air openings 40 therein provide the frame structure with a planar air inlet face with the frame structure also having a planar air outlet face which is open as indicated at 42. The water distribution trough shaped top frame member 28 is formed with a depending flange 44, the side frame members 30 and 32 are formed with inwardly extending flanges 46 and 48, respectively, and the bottom frame member 34 is formed with an upstanding flange 50. The flanges 44, 46, 48 and 50 all lie in the plane of the open air outlet face 42 of the frame structure 20 and surroundingly define that open air outlet face.

The above described frame structure 20 is well known in the art and is in common usage. However, that frame structure 20 has been modified in accordance with the present invention by providing a plurality of apertures 52 in spaced increments along the length of the depending flange 44 of the trough-shape upper frame member 28, as will hereinafter be described in detail.

As is customary, the wettable pad medium 22 is demountably placed in the air passage 38 of the frame structure 20. The wettable pad medium 22 may be formed of various materials and configurations which are formed into pad-shaped configuration and which permit a relatively free flow of air therethrough and contain a wettable material. The illustrated wettable pad medium 22 is one that has been in use for many years and includes an excelsior material which is loosely packed in a cheese cloth or similar wrapper. The pad medium 22 is placed in the frame structure 20 so that one surface of the pad medium is in engagement with the inwardly disposed surface of the air inlet face plate 36 of the frame structure 20 and the other surface of the pad lies in the open air outlet face 42 thereof.

The grill means 24 is used to demountably hold the wettable pad medium 22 in place in the frame structure 20 as will become apparent as this description progresses.

Before proceeding with the detailed description of the grill means 24, it will be understood that cooler pad assemblies are manufactured in various sizes to match the variously sized evaporative coolers. Therefore, the grill means 24 may be manufactured in various sizes and differing configuration to suit the various cooler pad assemblies. The illustrated cooler pad assembly 14 may be considered as an intermediate size and the following description will be of a size and configuration which is suitable for use in an intermediate assembly.

The illustrated grill means 24 is seen to include three independent and separate grill segments 54, 56 and 58 which are identical to each other. Due to the identical nature of the grill segments, the following description of the segment 54 will be understood to also apply to the other grill segments 56 and 58.

The grill segment 54 includes at least a pair of spaced apart elongated rods 60 and 62 which are interconnected, such as by welding, by a plurality of incrementally spaced cross rod means 64. The aligned upper ends of the elongated rods 60 and 62 are bent or otherwise formed to provide a hook 66 on the upper end of each of those rods. The hooks 66 are passed through aligned ones of the apertures 52 that are formed through the depending flange 44 of the trough-shape frame member 28 located at the top of the frame structure 20 so as to demountably connect the grill segment 24 thereto.

Figure 3:
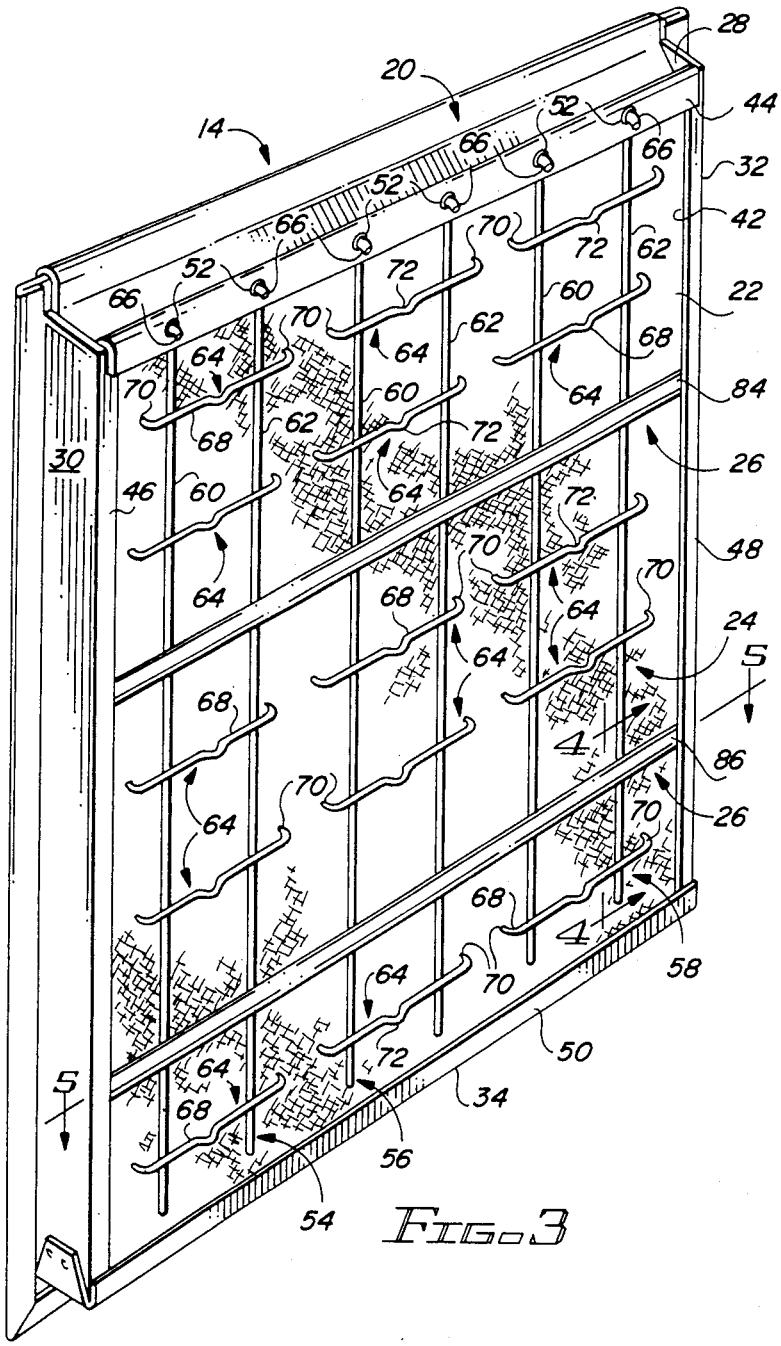
FIG. 3 is a perspective view of the cooler pad assembly of the present invention.

Each of the incrementally spaced cross rods means 64 is preferably of substantially C-shaped configuration to provide a bight portion 68 and a pair of spaced apart prongs 70 which coextend at right angles from the opposite ends of the bight portion. Each of the cross rod means 64 is provided with a hump 72 intermediate its opposite ends for reasons which will hereinafter be described. As seen best in FIG. 3, the cross rod means 64 are alternately offset with respect to each other laterally of the elongated rods 60 and 62.

When the above described grill segment 54 is mounted, the hooks 66 thereof are passed through the aligned ones of the apertures 52 of the depending flange 44 and the grill segment is swung into bearing engagement with the wettable pad medium 22. When the grill segment 54 is swung into place, the hooks 66 will act like pivots so that the grill segment 54 will move in an arcuate path. Such movement will cause the prongs 70 of the cross rod means 64 to penetrate the pad medium 22 with a slightly lifting effect. That is, the prongs 70 will tend to move the pad 22 up toward the trough-shaped top frame member 28. This, in conjunction with prong penetration per se, will help hold the pad medium 22 in the proper place within the frame structure 20 by resisting sagging thereof due to the weight of the water therein during operation of the evaporative cooler 10. The above mentioned preferred laterally and alternately offset placement of the plural cross rod means 64 will enhance the pad holding capabilities of the prongs 70.

Figure 2A:
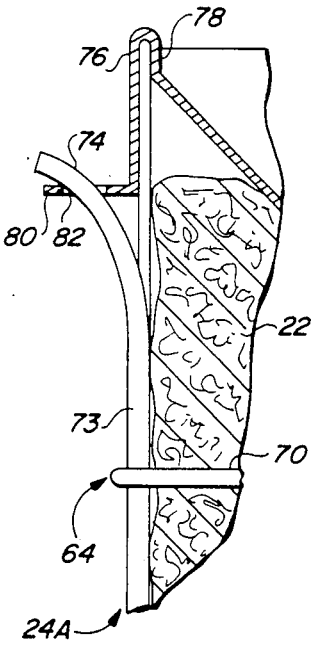
FIG. 2A is an enlarged fragmentary view similar to FIG. 2 but showing a modification of the cooler pad assembly of the present invention.

Reference is now made to FIG. 2A wherein a modification of the cooler pad assembly of the present.invention is illustrated. In the modified grill means 24A, the upper ends of the elongated rods 73 (one shown) are curved to form the hooks 74 (one shown) rather than being bent at a right angle as hereinbefore shown and described. To accommodate the curved hooks 74, the depending flange 76 of the top frame member 78 is provided with a ledge 80 which extends normally from the lower edge of the flange. A plurality of apertures 82 (one shown) are formed in spaced increments along the length of the ledge 80 for receiving the curved hooks 74 of the grill means in a manner similar to that hereinbefore described. As hereinbefore mentioned, evaporative cooler pad assemblies are manufactured in various sizes, and, for that reason, it is to be understood that the grill means 24 can be fabricated with varying numbers of the above described grill segments 54, 55 and 56. In relatively small cooler pad assemblies, two of the grill segments can be used and more than the illustrated three can be used in larger pad assemblies.

For manufacturing standardization reasons, it is preferred that the independent grill segments be fabricated as shown and described and that the grill means be made up of whatever number of grill segments are needed to suit the sizes of the cooler pad assemblies. However, it will be appreciated that the grill segments could be manufactured with more than the two illustrated elongated rods 60 and 62. For example, a grill segment (not shown) could be made with three or more of the elongated rods interconnected by the cross rod means 64 arranged in a staggered array. If this were accomplished, a single grill segment of that configuration could be used as the entire grill means.

In any event, it will be noticed that the three grill segments 54, 56 and 58 which form the illustrated grill means 24 are connected in the described manner to the trough-shaped top frame member 28 and are otherwise not in engagement with any other part of the frame structure 20. Therefore, the grill mounting retainer means 26 are used to complete the demountable assembly of the grill means 24 to the frame structure 20.

The grill mounting retainer means 26 includes at least one elongated bar 84 with a second identical elongated bar 86 being shown in the illustrated evaporative cooler pad assembly 14. It will be appreciated that a single elongated bar can be used in smaller cooler pad assemblies and more can be used in accordance with the size of the pad assembly. In that the retainer bars 84 and 86 are identical, the following description of the retainer bar 86 will also apply to the other retainer bar 84.

Figure 4:
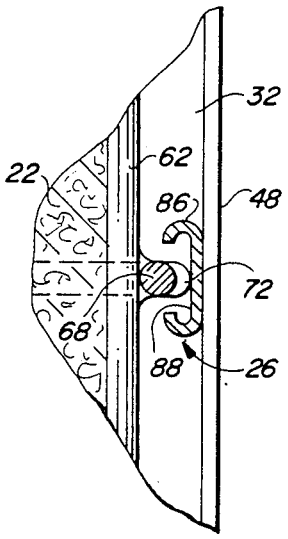
FIG. 4 is an enlarged fragmentary sectional view taken along the line 4—4 of FIG. 3.
Figure 5:
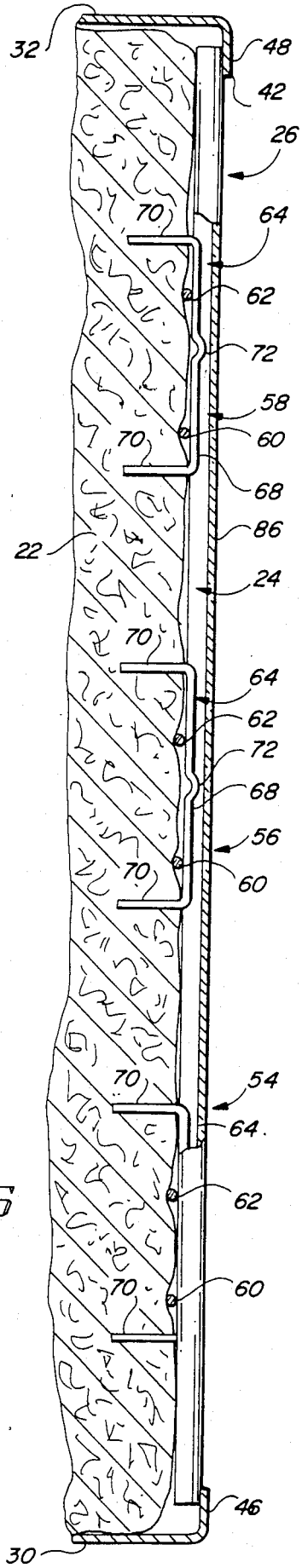
FIG. 5 is an enlarged sectional view taken along the line 55 of FIG. 3.

As seen best in FIG. 4, the retainer bar 86 is preferably of substantially C-shape in cross section so as to define a longitudinally extending open channel 88. When the retainer bar 86 is installed, as will hereinafter be described, the bight portions 68, and the offset humps 72 of aligned cross rod means 64 will be received in the open channels 88 of the retainer bar 86 thus effectively hold it in the desired installed position. As seen in FIG. 5, the retainer bar 86 has a length dimension which is somewhat larger than the distance between the inwardly disposed edges of the flanges 46 and 48 of the opposed side frame members 30 and 32 respectively. And, in the installed position, the opposite ends of the retainer bar 86 are interposed between the wettable pad medium 22 and the flanges 46 and 48 of the side frame members.

To install the retainer bar 86, one of its opposite ends is placed in the above described installed interposed position with the bar being disposed in an angular attitude, e.g. not transverse, between the side frame members 30 and 32. The opposite end of the retainer bar 86 is then placed under its respective one of the flanges and the bar 86 is then moved from its angular attitude into the illustrated transverse position. Such movement is easily accomplished due to the loosely packed and resilient nature of the wettable pad medium 22 that allows the grill means 24 to be pushed toward the air inlet face plate 36 of the frame structure 20 during movement of the retainer rod 86.

Figure 6:
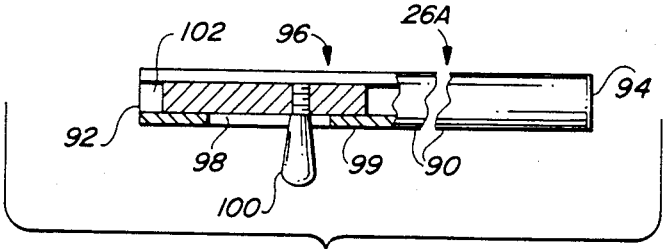
FIG. 6 is a fragmentary view which is partially broken away to show a modification of the grill mounting means of the present invention.

A modified form of retainer means 26A is shown in FIG. 6 as including an elongated rod 90 of substantially C-shaped cross section similar to the above described retainer rods 84 and 86. The retainer rod 90 has one of its opposite ends 92 and 94 as having been modified to include a longitudinally extensible latch means 96. The rod end 92 has a closed ended slot 98 formed in the bight portion 99 thereof proximate that end 92, and a knob 100 extends from the latch means 96 through the slot 98. The latch means 96 is in the form of a plate which is slidably movable in the channel 102 with such sliding movement being accomplished by manual manipulation of the knob 100. Installation of the modified retainer means 26A is simplified in that it can be installed directly in the transverse position with the latch means 96 being in the retracted position. When the retainer rod is so positioned, the latch means is manually moved to the longitudinally extended position to complete mounting of the retainer means 26A.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A cooler pad assembly for use in an evaporative cooler comprising in combination:

(a) a frame structure including a top frame member, a bottom frame member and an opposed pair of side frame members, said top, bottom and pair of side frame members cooperatively defining an air passage having a planar air inlet face and an open air outlet face and each having a flange which cooperatively surround the open air outlet face of said frame structure;

(b) a wettable pad medium in the air passage of said frame structure;

(c) grill means demountably connected to the flange of said top frame member so as to depend therefrom toward said bottom frame member, said grill means lying substantially in the plane of the open air outlet face of said frame structure and in engagement with said wettable pad medium to demountably retain said pad medium in the air passage defined by said frame structure, said grill means is configured to be in spaced non-engaging relationship with respect to the bottom and opposed side frame members of said frame structure; and (d) retainer means in engagement with said grill means, said retainer means having opposite ends which are in demountable engagement with said side frame members of said frame structure to demountably hold said grill means in engagement with said pad means.

2. A cooler and pad assembly for use in an evaporative cooler comprising in combination:

(a) a frame structure including a top frame member, a bottom frame member and an opposed pair of side frame members, said top, bottom and pair of side frame members cooperatively defining an air passage having a planar air inlet face and an open air outlet face and each having a flange which cooperatively surround the open air outlet face of said frame structure;

(b) a wettable pad medium in the air passage of said frame structure;

(c) grill means demountably connected to the flange of said top frame member so as to depend therefrom toward said bottom frame member, said grill means lying substantially in the plane of the open air outlet face of said frame structure and in engagement with said wettable pad medium to demountably retain said pad medium in the air passage defined by said frame structure, said grill means including, I. at least a spaced apart pair of elongated rods each having an upper end with means on its upper end for demountable connection to the flange of the top frame member of said frame structure, said pair of elongated rods each having a bottom end and a length dimension which locates the bottom ends in spaced non-engaging relationship with respect to the bottom frame member of said frame structure, said pair of elongated rods being spaced apart a distance which locates said pair of elongated rods in spaced non-engaging relationship with respect to the opposed side frame members of said frame structure, II. at least a pair of cross rod means fixedly interconnecting said pair of elongated rods at spaced apart locations along the lengths thereof, each of said cross rod means being disposed tranversely of said pair of elongated rods, said pair of cross rod means each having a length dimension which locates them in spaced non-engaging relationship with respect to the opposed side frame members of said frame structure; and (d) retainer means in engagement with said grill means, said retainer means having opposite ends which are in demountable engagement with said side frame members of said frame structure to demountably hold said grill means in engagement with said pad means.

3. A cooler pad assembly as claimed in claim 1 wherein said grill means comprises:

(a) at least a spaced apart pair of elongated rods each having an upper end with means on its upper end for demountable connection to the flange of the top frame member of said frame structure; and (b) at least a pair of cross rods means fixedly interconnecting said pair of elongated rods at spaced apart locations along the lengths thereof, each of said cross rod means being disposed transversely of said pair of elongated rods.

4. A cooler pad assembly as claimed in claim 2 wherein said retainer means includes at least one elongated bar.

5. A cooler pad assembly as claimed in claim 4 wherein said elongated bar is in engagement with at least one of said cross rod means to hold said elongated bar against vertical displacement.

6. A cooler pad assembly as claimed in claim 2 and further comprising:

(a) said flange of said top frame member of said frame structure being provided with at least a pair of spaced apart apertures; and (b) said means on the upper end of each of said pair of elongated rods being in the form of hook means which are in demountable hooked engagement with the apertures provided in said flange of said top frame member of said frame structure.

7. A cooler pad assembly as claimed in claim 2 wherein each of said pair of cross rod means is of substantially U-shaped configuration to provide a bight portion which transversely interconnects said pair of elongated rods and a pair of prongs which coextend normally from the opposite ends of said bight portion into penetrating engagement with said wettable pad medium.

8. A cooler pad assembly as claimed in claim 7 wherein said retainer means includes at least one elongated bar of substantially C-shaped cross section to define a longitudinally extending channel in which said bight portion of at least one of said cross rod means is disposed to hold said elongated bar against vertical displacement.

9. A cooler pad assembly as claimed in claim 7 wherein the bight portion of each of said cross rod means has an offset hump intermediate its ends.

10. A cooler pad assembly as claimed in claim 9 wherein said retainer means includes at least one elongated bar of substantially C-shaped cross section to define a longitudinally extending channel in which the bight portion and offset hump of at least one of said cross rod means is disposed to hold said elongated bar against vertical displacement.

11. A cooler pad assembly as claimed in claim 1 wherein said retainer means is in the form of a least one elongated bar one end of which is provided with a longitudinally extensible latch means having a retracted position wherein that one end of said elongated bar is disengaged from its adjacent one of said opposed pair of side frame members of said frame structure and having an extending position wherein that one end of said elongated bar is in demountable engagement with its adjacent one of said opposed pair of side frame members of said frame structure.

12. A cooler pad assembly fo use in an evaporative cooler comprising in combination:

(a) a frame structure including a top frame member, a bottom frame member and an opposed pair of side frame members, said top, bottom and pair of side frame members cooperatively defining an air passage having a planar air inlet face and an open air outlet face and each having a flange which cooperatively surround the open air outlet face of said frame structure;

(b) a wettable pad medium in the air passage of said frame structure;

(c) at least a pair of independent grill segments each demountably connected to the flange of said top frame member so as to extend therefrom toward said bottom frame member, said grill segments lying substantially in the plane of the open air outlet face of said frame structure and in engagement with said wettable pad medium to demountably hold said pad medium in the air passage defined by said frame structure, said independent grill segments are configured and demountably connected to the flange of said top frame member so as to be in spaced non-engaging relationship with respect to each other and with respect to said bottom and opposed side frame members of said frame structure; and (d) retainer means in engagement with said grill segments, said retainer means having opposite ends which are in demountable engagement with said side frame members of said frame structure to demountably hold said grill segments in engagement with said pad means.

13. A cooler pad assembly as claimed in claim 12 wherein each of said independent grill segments comprises:

(a) at least a pair of spaced apart elongated rods each having an upper end with means on its upper end for demountable connection to the flange of the top frame member of said frame structure; and (b) at least a pair of cross rod means fixedly interconnecting said pair of elongated rods at spaced apart locations along the lengths thereof, each of said cross rod means being disposed transversely of said elongated rods.

14. A cooler pad assembly as claimed in claim 13 and further comprising:

(a) said elongated rods each having a bottom end and a length dimension which locates the bottom end in spaced non-engaging relationship with respect to the bottom frame members of said frame structure; and (b) said cross rod means holding said elongated rods in a spaced relationship where they are in spaced non-engaging relationship with respect to adjacent independent grill segments and with respect to the opposed side frame members of said frame structure, said cross rod means each having a length dimension which locates them in spaced non-engaging relationship with respect to adjacent independent grill segments and with respect to the opposed side frame members of said frame structure.

15. A cooler pad assembly as claimed in claim 14 wherein said retainer means includes at least one elongated bar.

16. A cooler pad assembly as claimed in claim 15 wherein said elongated bar is in engagement with one of said cross rod means of each of said independent grill segments to hold said elongated bar against vertical displacement.

17. A cooler pad assembly as claimed in claim 13 and further comprising:

(a) said flange of said top frame member of said frame structure having a plurality of incrementally spaced apertures formed along the length thereof; and (b) said means on the upper end of each of said elongated rods of each of said independent grill segments being in the form of a hook means each of which is in hooked engagement with a different one of the apertures formed in the flange of the top frame member of said frame structure.

18. A cooler pad assembly as claimed in claim 13 wherein each of said cross rod means of each of said independent grill segments is of substantially U-shaped configuration to provide a bight portion which transversely interconnects said elongated rods of its respective one of said independent grill segments and to provide a pair of prongs which coextend normally from the opposite ends of said bight portion into penetrating engagement with said pad medium.

19. A cooler pad assembly as claimed in claim 18 wherein said retainer means includes at least one elongated bar of substantially C-shaped cross section to define a longitudinally extending channel in which the bight portion of one of said cross rod means of each of said independent grill segments is disposed to hold said elongated bar against vertical displacement.

20. A cooler pad assembly as claimed in claim 18 wherein the bight portion of each of said cross rod means has an offset hump formed therein intermediate its ends.

21. A cooler pad assembly as claimed in claim 20 wherein said retainer means includes at least one elongated bar of substantially C-shaped cross section to define a longitudinally extending channel in which the bight portion and the offset hump of one of said cross rod means of each of said independent grill segments is disposed to hold said elongated bar against vertical displacement.

22. A cooler pad assembly as claimed in claim 12 wherein said retainer means is in the form of at least one elongated bar one end of which is provided with a longitudinally extensible latch means having a retracted position wherein that one end of said elongated bar is disengaged from its adjacent one of said opposed pair of side frame members of said frame structure and having an extended position wherein that one end of said elongated bar is in demountable engagement with its adjacent one of said opposed pair of side frame members of said frame structure.

* * * * *